US011436997B2

(12) United States Patent
Wu

(10) Patent No.: US 11,436,997 B2
(45) Date of Patent: Sep. 6, 2022

(54) ELECTRONIC DEVICE AND AMBIENT LIGHT SENSING METHOD THEREOF

(71) Applicant: EMINENT ELECTRONIC TECHNOLOGY CORP. LTD., Hsin-Chu (TW)

(72) Inventor: Kao-Pin Wu, New Taipei (TW)

(73) Assignee: EMINENT ELECTRONIC TECHNOLOGY CORP. LTD., Hsin-Chu (TW)

( * ) Notice: Subject to any disclaimer, the term of this patent is extended or adjusted under 35 U.S.C. 154(b) by 0 days.

(21) Appl. No.: 17/134,017

(22) Filed: Dec. 24, 2020

(65) Prior Publication Data

US 2021/0201851 A1 Jul. 1, 2021

Related U.S. Application Data

(60) Provisional application No. 62/955,353, filed on Dec. 30, 2019.

(30) Foreign Application Priority Data

Sep. 14, 2020 (TW) ..... 109131520

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/064* (2013.01); *G09G 2360/141* (2013.01); *G09G 2360/144* (2013.01)

(58) Field of Classification Search
CPC ..... G09G 2360/144; G09G 3/30–3291
See application file for complete search history.

(56) References Cited

U.S. PATENT DOCUMENTS

2007/0035489 A1* 2/2007 Lee ..... G09G 3/3233 345/77
2015/0348509 A1* 12/2015 Verbeure ..... G06T 1/20 345/213

(Continued)

FOREIGN PATENT DOCUMENTS

TW 201128629 A 8/2011
TW 201727457 A 8/2017

OTHER PUBLICATIONS

Examination report issued in corresponding Taiwan Application No. 109131520 dated Mar. 18, 2021 (20 pages).

*Primary Examiner* — Hang Lin
(74) *Attorney, Agent, or Firm* — Muncy, Geissler, Olds & Lowe, P.C.

(57) ABSTRACT

An electronic device includes an OLED display having a plurality of pixels and an ambient light sensor disposed under a first pixel of the plurality of pixels. In a first sensing interval, the ambient light sensor generates a first sensing value. The first sensing interval includes a first period and a second period. The first pixel has a first brightness in the first period and has a second brightness the second period. In a second sensing interval, which has the same time length as the first sensing interval, the ambient light sensor generates a second sensing value. The first pixel has the second brightness in the second sensing interval. The first pixel has an identical hue in the first sensing interval and the second sensing interval. The ambient light sensor acquires an ambient light intensity according to the first sensing value and the second sensing value.

23 Claims, 11 Drawing Sheets

(56) References Cited

U.S. PATENT DOCUMENTS

| | | | | |
|---|---|---|---|---|
| 2018/0143727 | A1* | 5/2018 | Reynolds | G02F 1/13338 |
| 2018/0274974 | A1* | 9/2018 | Wang | G01J 1/00 |
| 2020/0219464 | A1* | 7/2020 | Callway | G06T 15/506 |

* cited by examiner

ELECTRONIC DEVICE AND AMBIENT LIGHT SENSING METHOD THEREOF

This application claims priority for the U.S. provisional patent application no. 62/955,353 filed on 30 Dec. 2019, and Taiwan (R.O.C.) patent application No. 109131520 filed on 14 Sep. 2020, the content of which is incorporated by reference in its entirely.

BACKGROUND OF THE INVENTION

Field of the Invention

The present invention relates to an electronic device, and more particularly, to an electronic device having an OLED display and an ambient light sensing method thereof Description of the Prior Art A mobile electronic device or a wearable electronic device equipped with a display, is likely to use an ambient light sensor to detect ambient brightness, whereby to adjust screen brightness. The conventional ambient light sensor is disposed in the perimeter area of the screen. However, with the need for higher screen-to-body ratio, the perimeter area of the screen for installing an ambient light sensor has become much smaller. For electronic devices having an organic light-emitting diode (OLED) display, it is possible that the ambient light sensor is disposed under the OLED display. As the OLED display needn't use a backlight module, light can pass through the OLED display to realize the under-display ambient light sensing function. However, in addition to the ambient light, the ambient light sensor on the backside of the OLED display may also receive the light from the OLED display.

SUMMARY OF THE INVENTION

One objective of the preset invention is to provide an electronic device having an OLED display and an ambient light sensing method thereof.

In one embodiment, the present invention provides an ambient light sensing method of an electronic device. The electronic device comprises an OLED display and an ambient light sensor. The OLED display has a plurality of pixels. The ambient light sensor is disposed under a first pixel of the plurality of pixels. The ambient light sensing method comprises steps: sensing light by the ambient light sensor in a first sensing interval to generate a first sensing value, wherein the first sensing interval includes a first period and a second period, and wherein the first pixel has a first brightness in the first period and has a second brightness in the second period; sensing light by the ambient light sensor in a second sensing interval to generate a second sensing value, wherein the length of the second sensing interval is the same as that of the first sensing interval, and wherein the first pixel has the second brightness in the second sensing interval; and acquiring an ambient light intensity according to the first sensing value and the second sensing value, wherein the first pixel has an identical hue in the first sensing interval and the second sensing interval.

In one embodiment, the present invention provides an ambient light sensing method of an electronic device. The electronic device comprises an OLED display and an ambient light sensor. The OLED display has a plurality of pixel rows adjacent to each other. The ambient light sensor is disposed under the pixel rows. The ambient light sensing method comprises steps: sensing light by the ambient light sensor in a first sensing interval to generate a first sensing value, wherein the brightness of the plurality of pixel rows changes from a first brightness to a second brightness in sequence in the first sensing interval; sensing light by the ambient light sensor in a second sensing interval to generate a second sensing value, wherein the length of the second sensing interval is the same as that of the first sensing interval, and wherein the plurality of pixel rows has the second brightness in the second sensing interval; and acquiring an ambient light intensity according to the first sensing value and the second sensing value, wherein the plurality of pixel rows has an identical hue in the first sensing interval and the second sensing interval.

In one embodiment, the present invention provides an ambient light sensing method of an electronic device. The electronic device comprises an OLED display and an ambient light sensor. The OLED display has a plurality of pixel rows adjacent to each other. The ambient light sensor is disposed under the pixel rows. The ambient light sensing method comprises steps: sensing light by the ambient light sensor in a first sensing interval to generate a first sensing value, wherein the first sensing interval includes a first period and a second period, and wherein each pixel row has a first brightness in the first period and has a second brightness in the second period; sensing light by the ambient light sensor in a second sensing interval to generate a second sensing value, wherein the length of the second sensing interval is the same as that of the first sensing interval, and wherein each pixel row has the second brightness of the second period in the second sensing interval; and acquiring an ambient light intensity according to the first sensing value and the second sensing value, wherein each pixel row has an identical hue in the first sensing interval and the second sensing interval.

In one embodiment, the present invention provides an electronic device comprising an OLED display and an ambient light sensor, wherein the OLED display has a plurality of pixels, and wherein the ambient light sensor is disposed under a first pixel of the plurality of pixels. The ambient light sensor generates a first sensing value in a first sensing interval, generates a second sensing value in a second sensing interval, and acquires an ambient light intensity according to the first sensing value and the second sensing value. The first sensing interval includes a first period and a second period. The first pixel has a first brightness in the first period and has a second brightness in the second period. The length of the second sensing interval is the same as that of the first sensing interval. The first pixel has the second brightness in the second sensing interval. The first pixel has an identical hue in the first sensing interval and the second sensing interval.

In one embodiment, the present invention provides an electronic device comprising an OLED display and an ambient light sensor, wherein the OLED display has a plurality of pixel rows adjacent to each other, and wherein the ambient light sensor is disposed under the plurality of pixel rows. The ambient light sensor generates a first sensing value in a first sensing interval, generates a second sensing value in a second sensing interval, and acquires an ambient light intensity according to the first sensing value and the second sensing value. In the first sensing interval, the brightness of the plurality of pixel rows changes from a first brightness to a second brightness. The length of the second sensing interval is the same as that of the first sensing interval. The plurality of pixel rows has the second brightness in the second sensing interval. The plurality of pixel rows has an identical hue in the first sensing interval and the second sensing interval.

In one embodiment, the present invention provides an electronic device comprising an OLED display and an ambient light sensor, wherein the OLED display has a plurality of pixel rows adjacent to each other, and wherein the ambient light sensor is disposed under the plurality of pixel rows. The ambient light sensor generates a first sensing value in a first sensing interval, generates a second sensing value in a second sensing interval, and acquires an ambient light intensity according to the first sensing value and the second sensing value. The first sensing interval includes a first period and a second period. Each pixel row has a first brightness in the first period and has a second brightness in the second period. The length of the second sensing interval is the same as that of the first sensing interval. Each pixel row has an identical hue in the first sensing interval and the second sensing interval.

DETAILED DESCRIPTION OF THE INVENTION

Light can pass through an OLED display. Therefore, an ambient light sensor can sense ambient light even though it is disposed under the OLED display. While an OLED display performs line scan, the pixels on the same row are temporarily turned off to update data in a blanking period.

Figure 1:
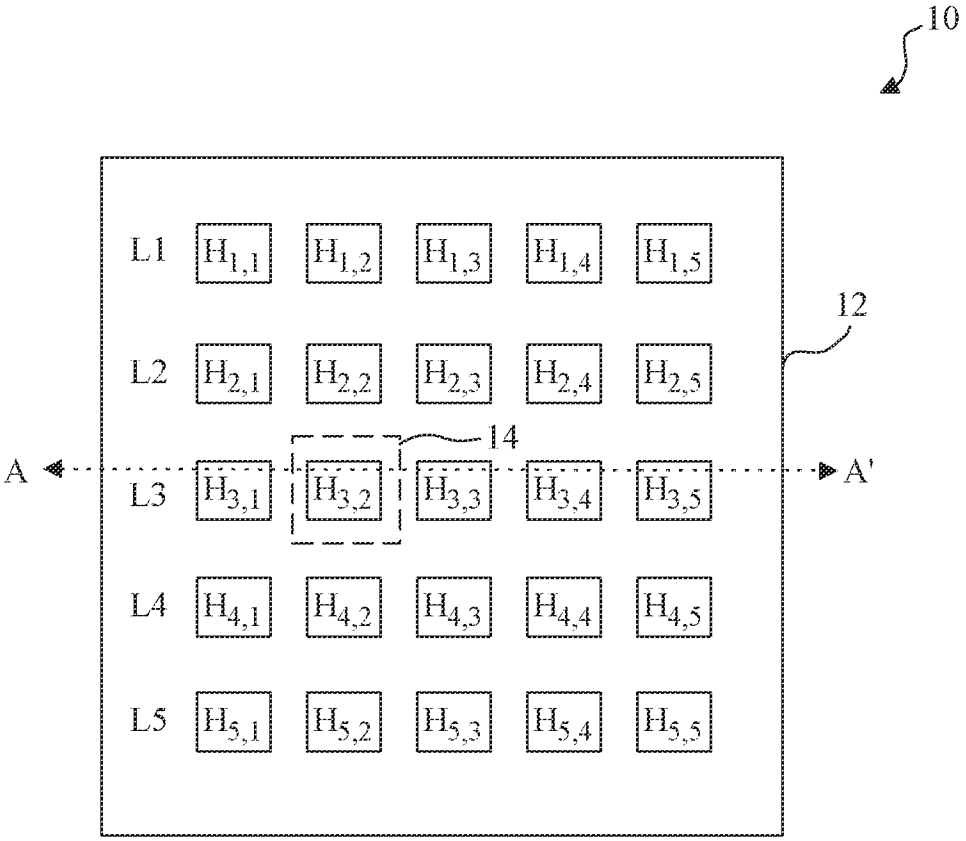
FIG. 1 schematically shows a first embodiment of an electronic device of the present invention.
Figure 2:
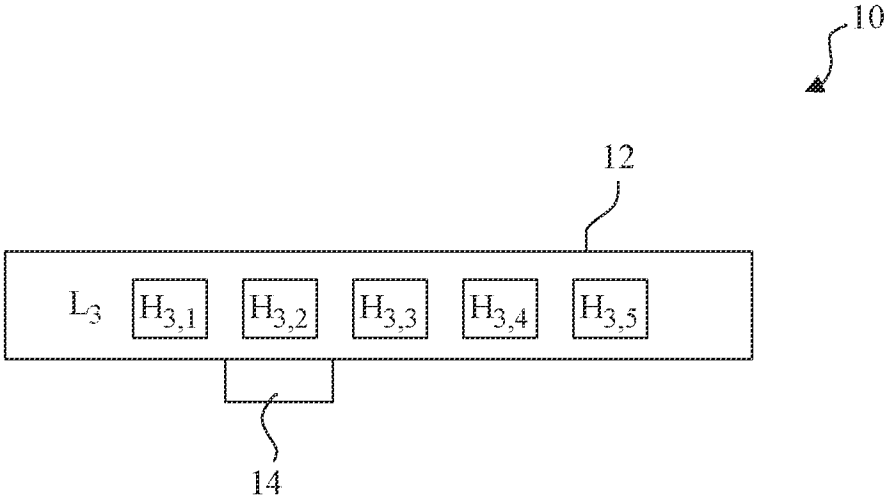
FIG. 2 shows a sectional view taken along section line AA' in FIG. 1.
Figure 3:
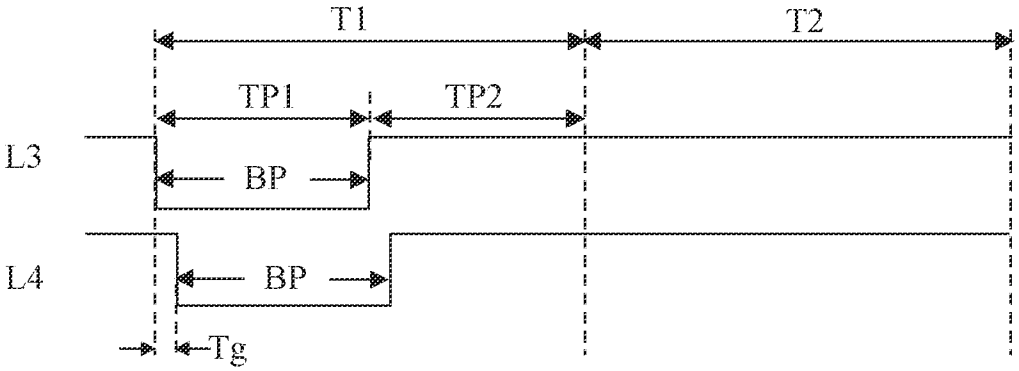
FIG. 3 shows a timing diagram of pixel rows L3 and L4 in FIG. 1.

FIG. 1 schematically shows a first embodiment of an electronic device of the present invention. FIG. 2 shows a sectional view taken along section line AA' in FIG. 1. FIG. 3 shows a timing diagram of pixel rows L3 and L4 in FIG. 1. Refer to FIGS. 1-3. The electronic device 10 comprises an OLED display 12 and an ambient light sensor 14. The ambient light sensor 14 is disposed under the OLED display 12. The OLED display 12 has a plurality of pixels $H_{1,1}$-$H_{5,5}$. Each of symbols L1-L5 represents a row of pixels. In the present invention, the number of the pixels and the number of the pixel rows of the OLED display 12 are not limited by FIG. 1. Taking a pixel row L3 in FIG. 3 as an example, in one frame of the OLED display 12, the operation timing of the pixel row L3 includes a short blanking period BP for updating data. In the blanking period BP, all the pixels $H_{3,1}$, $H_{3,2}$, $H_{3,3}$, $H_{3,4}$, and $H_{3,5}$ of the pixel row L3 are turned off simultaneously. While the blanking period BP ends, all the pixels $H_{3,1}$, $H_{3,2}$, $H_{3,3}$, $H_{3,4}$, and $H_{3,5}$ of the pixel row L3 are turned on simultaneously. Compared with of the blanking period BP of the pixel row L3, the beginning time point of the blanking period BP of the adjacent pixel row L4 is delayed by a first time gap Tg. The ambient light sensor 14 is disposed under a first pixel $H_{3,2}$. In one embodiment, the ambient light sensor 14 is disposed under a plurality of pixels of the same row. For example, the ambient light sensor 14 is disposed under the pixels $H_{3,2}$, $H_{3,3}$ and $H_{3,4}$. In FIG. 3 and other drawings, the symbols T1 and T2 respectively represent a first sensing interval and a second sensing interval, and the symbol BP represents the blanking period of each of pixel rows.

Figure 4:
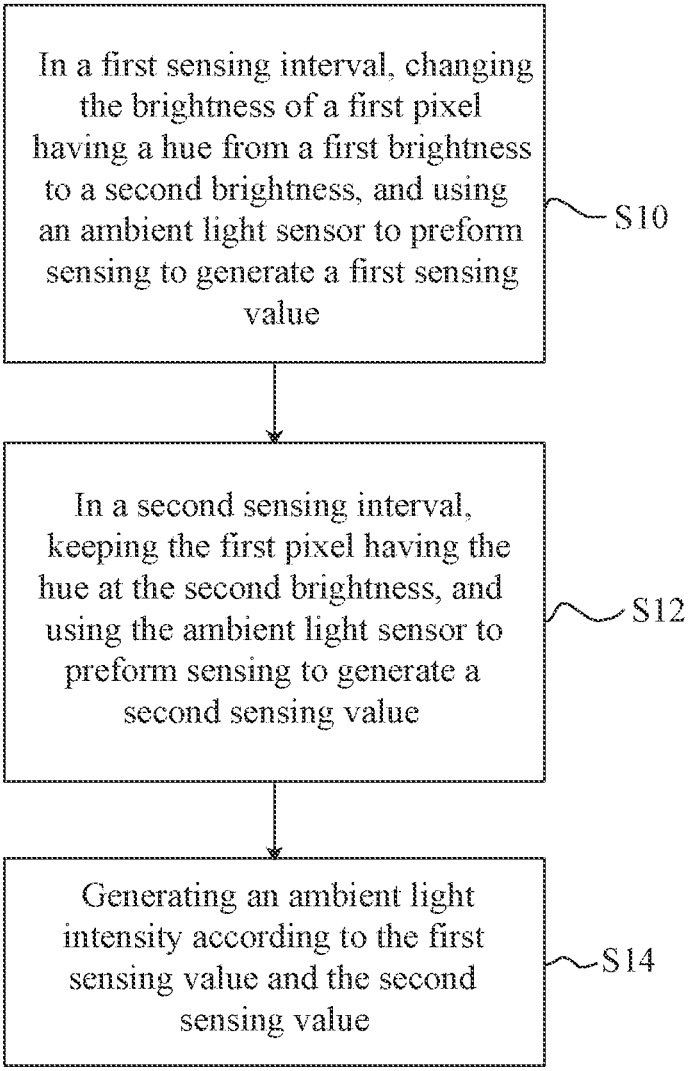
FIG. 4 shows a first embodiment of an ambient light sensing method of the present invention.

FIG. 4 shows a first embodiment of an ambient light sensing method of the present invention. Please also refer to FIG. 3 and FIG. 4. In the step S10, the ambient light sensor 14 performs a first sensing in the first sensing interval T1. In the first sensing interval T1, the brightness of a first pixel $H_{3,2}$ changes from a first brightness to a second brightness. As shown in FIG. 3, a first period TP1 of the first sensing interval T1 is the blanking period BP of the pixel row L3. In the first period TP1, all the pixels of the pixel row L3 are turned off. Therefore, the first brightness of the first pixel $H_{3,2}$ is zero in the first period TP1. After the first period TP1 ends and a second period TP2 starts, the first pixel $H_{3,2}$ is turned on to have a non-zero second brightness Ls. The ambient light sensor 14 senses light in the first sensing interval T1 to generate a first sensing value CountA. Assume that the hue of the first pixel $H_{3,2}$ is Hs. The first sensing value CountA may be expressed by equation EQ-1 as follows:

$$\text{CountA}=\text{AL}+\text{Hs}\times\text{Ls}(1-\text{TP1}/T1) \qquad \text{EQ-1}$$

wherein AL represents the ambient light brightness. After the step S10 ends, the process proceeds to the step S12. In the step S12, the ambient light sensor 14 performs a second sensing in the second sensing interval T2, wherein the length of the second sensing interval T2 is the same as the length of the first sensing interval T1. For the pixel row L3, FIG. 3 shows that the second period TP2 and the second sensing interval T1 are in the same frame. Therefore, the first pixel $H_{3,2}$ has the same hue Hs and the second brightness Ls in the second sensing interval T2. The ambient light sensor 14 senses light in the second sensing interval T2 to generate a second sensing value CountB. The second sensing value CountB may be expressed by equation EQ-2 as follows:

$$\text{CountB}=\text{AL}+\text{Hs}\times\text{Ls} \qquad \text{EQ-2}$$

In the step S14, an ambient light intensity is generated according to the first sensing value CountA and the second sensing value CountB. Because the first sensing value CountA and the second sensing value CountB are generated by the ambient light sensor 14 and TP1 and T1 are parameters preset in the electronic device 10, it is able to eliminate Hs×Ls by solving the simultaneous equations formed by the equations EQ-1 and EQ-2 so as to calculate the ambient light intensity AL.

Figure 5:
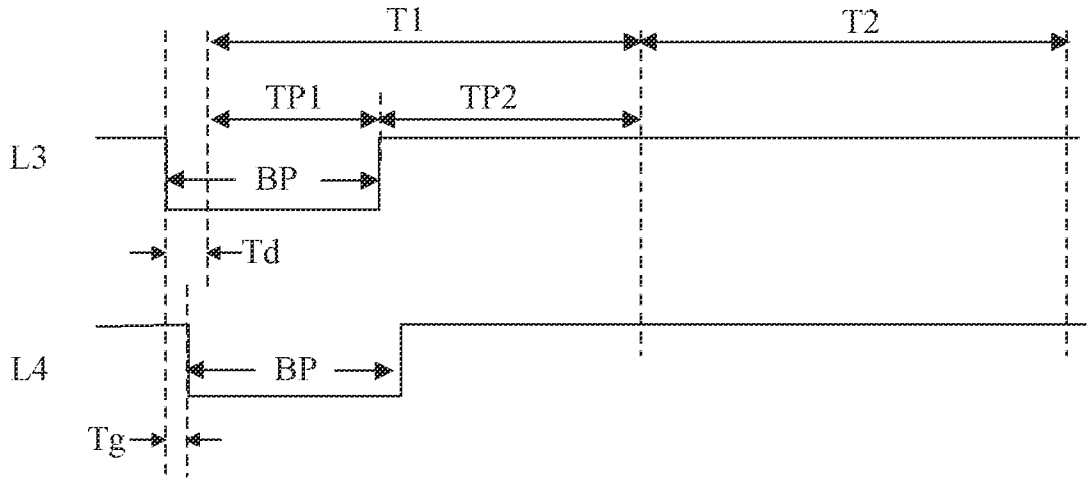
FIG. 5 schematically shows another embodiment of the beginning point of the first sensing interval.

In the embodiment of FIG. 3, the beginning point of the first sensing interval T1 is the beginning point of the blanking period BP of the first pixel $H_{3,2}$. The first period TP1 is whole of the blanking period BP for updating the pixel row L3. However, the present invention is not limited by this embodiment. In the embodiment shown in FIG. 5, the beginning point of the first sensing interval T1 is later than the beginning point of the blanking period BP of the first pixel $H_{3,2}$ by a time delay Td. Therefore, the first period TP1 is now a portion of the blanking period BP. In the embodiment shown in FIG. 5, the length of the first sensing interval T1 is the same as the length of the second sensing interval T2. The time delay Td may be predetermined. Therefore, the first period TP1 is a known parameter which can be derived from: TP1=BP−Td. Thus, the ambient light intensity AL may be obtained according to the method shown in FIG. 4.

Figure 6:
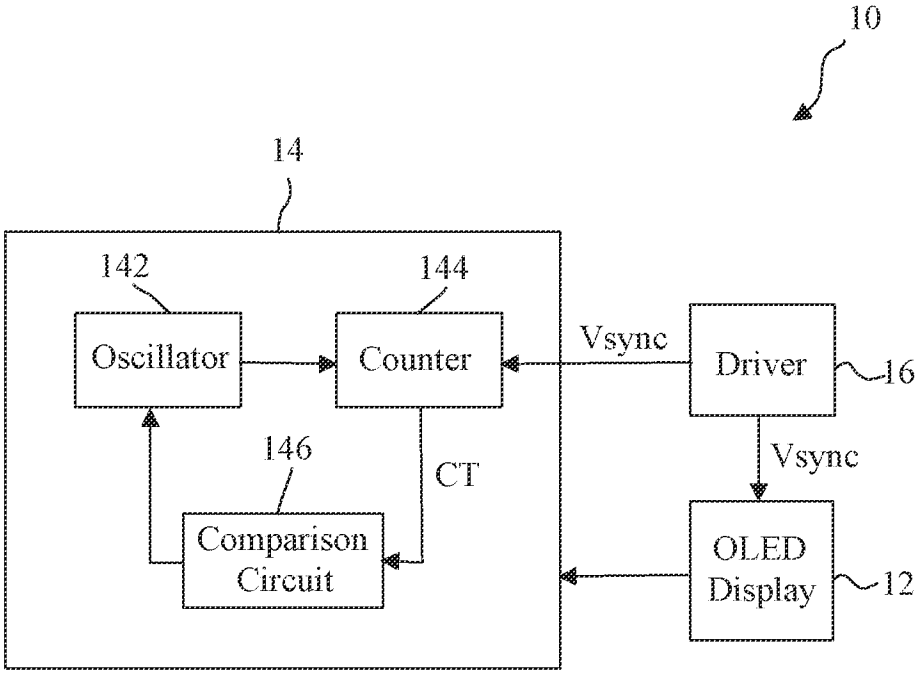
FIG. 6 is a block diagram schematically showing an electronic device according to one embodiment of the present invention.

FIG. 6 is a block diagram schematically showing an electronic device 10 according to one embodiment of the present invention. In addition to the OLED display 12 and the ambient light sensor 14, the electronic device 10 in FIG. 6 further comprises a driver 16 for driving the OLED display 12. The driver 16 provides a vertical synchronous signal Vsync to the OLED display 12 and the ambient light sensor 14. The vertical synchronous signal Vsync indicates a beginning point or an ending point of a frame. In other words, the time between two vertical synchronous signals Vsync is time of a frame of the OLED display 12, or the time between two vertical synchronous signals Vsync is for the OLED display 12 to show a frame of picture. The ambient light sensor 14 further comprises an oscillator 142, a counter 144, and a comparison circuit 146. The oscillator 142 provides a first operating frequency to the counter 144. According to the first operating frequency CK1, the counter 144 counts the time between two vertical synchronous signals Vsync to generate a count value CT. The comparison circuit 146 determines whether the oscillator 142 needs calibration according to the count value CT and a preset value. For example, assume that the preset operating frequency of the ambient light sensor 14 is 1 MHz and the standard frame rate of the OLED display 12 is 60 FPS (Frame Per Second), time of a frame is 16.667 ms. Then, the preset value may be set to be 16667. While the frame rate of the OLED display 12 becomes larger (faster), the count value will be smaller than 16667. Thus, the comparison circuit 146 calibrates the oscillator 142 to generate a second operating frequency, which is higher than the first operating frequency. While the frame rate of the OLED display 12 becomes smaller (slower), the count value will be larger than 16667. Thus, the comparison circuit 146 calibrates the oscillator 142 to generate a second operating frequency, which is lower than the first operating frequency. Consequently, the ambient light sensor 14 can perform sensing accurately from the beginning point of the blanking period BP of the pixel row L3 or another preset point.

Figure 7:
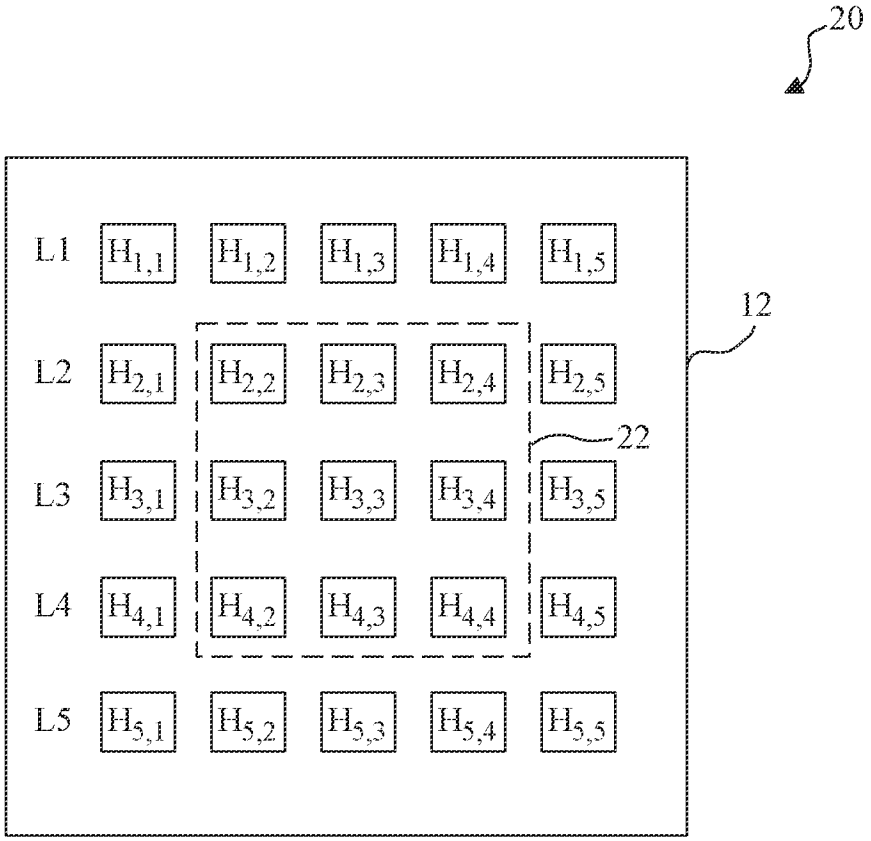
FIG. 7 schematically shows a second embodiment of an electronic device of the present invention.
Figure 8:
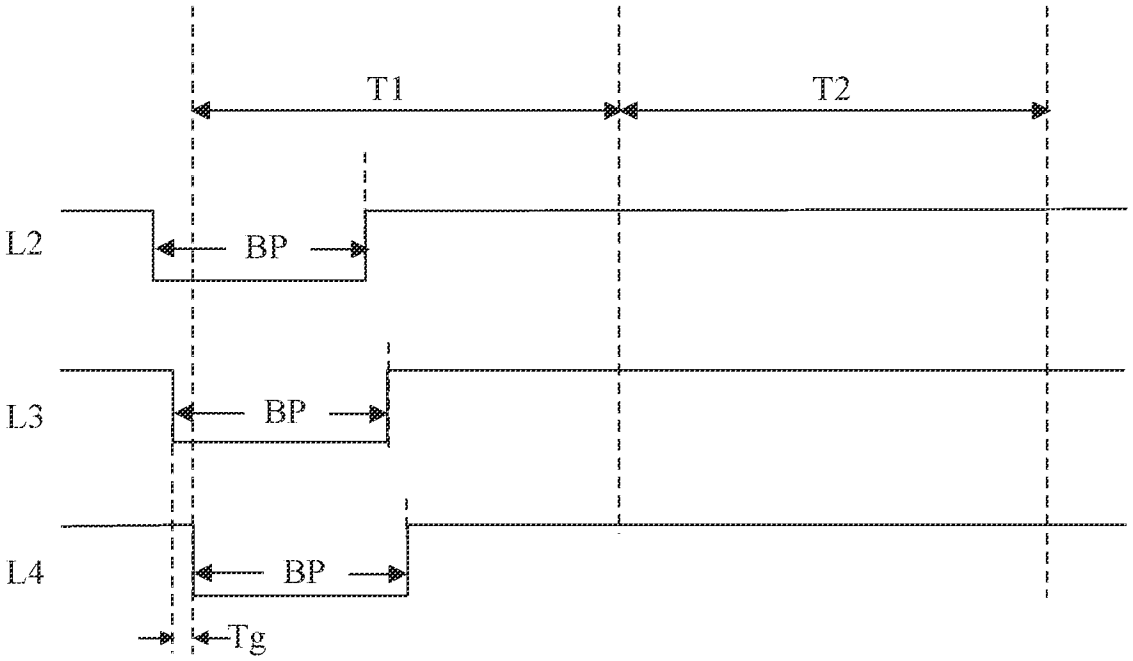
FIG. 8 shows a timing diagram of the pixel rows L2, L3 and L4 in FIG. 7.

Refer to FIG. 7. FIG. 7 schematically shows a second embodiment of an electronic device of the present invention. In FIG. 7, the electronic device 20 comprises an OLED display 12 and an ambient light sensor 22. The ambient light sensor 22 is disposed under a plurality of pixel rows L2, L3 and L4. In details, the ambient light sensor 22 is disposed under the pixels $H_{2,2}$, $H_{2,3}$, $H_{2,4}$, $H_{3,2}$, $H_{3,3}$, $H_{3,4}$, $H_{4,2}$, $H_{4,3}$ and $H_{4,4}$. FIG. 8 shows the timing diagram of the pixel rows L2, L3 and L4. The operation timing of each of the pixel rows L2, L3 and L4 has a blanking period BP for updating the display information. The beginning time point of the blanking period BP of the pixel row L4 is later than the beginning time point of the blanking period BP of the preceding pixel row L3 by a first time gap Tg. The beginning time point of the blanking period BP of the pixel row L3 is also later than the beginning time point of the blanking period BP of the preceding pixel row L2 by the first time gap Tg. In FIG. 8, the beginning point of the first sensing interval T1 is at the beginning point of the blanking period BP of the last pixel row L4, and the ending point of the first sensing interval T1 is after the ending point of the blanking period BP of the last pixel row L4. In the first sensing interval T1, the brightness of the pixel rows L2, L3 and L4 changes in sequence from a first brightness in the blanking period BP to a second brightness after the blanking period BP. In this embodiment, each of the pixel rows L2, L3 and L4 has the same first brightness and the same hue in the blanking period BP, and each of the pixel rows L2, L3 and L4 also has the same second brightness and the same hue after the blanking period BP. In the second sensing interval T2, each of the pixel rows L2, L3 and L4 maintains the same second brightness and the same hue after the blanking period BP. In another embodiment, the beginning point of the first sensing interval T1 is after the beginning point of the blanking period BP of the last pixel row L4 but before the ending point of the blanking period BP of the last pixel row L4; however, the ending point of the first sensing interval T1 must be after the ending point of the blanking period BP of the last pixel row L4.

Figure 9:
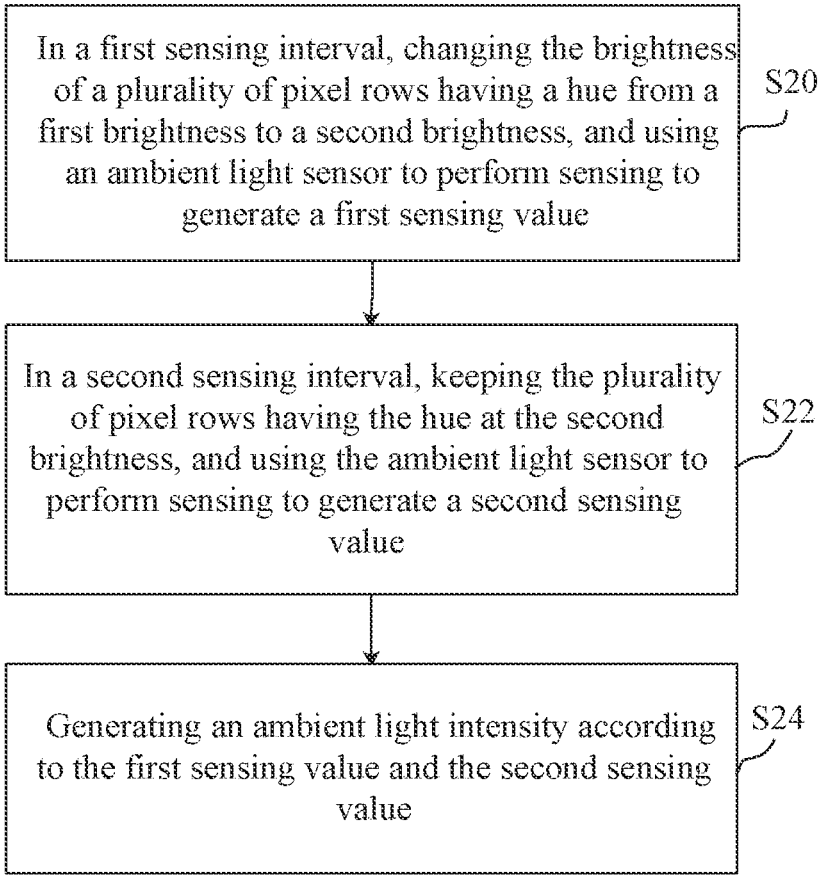
FIG. 9 shows a second embodiment of an ambient light sensing method of the present invention.

FIG. 9 shows a second embodiment of an ambient light sensing method of the present invention. Refer to FIGS. 7-9. In the step S20, the ambient light sensor 22 performs a first sensing in a first sensing interval T1. In this embodiment, the brightness of the pixel rows L2, L3 and L4 changes in sequence from a first brightness to a second brightness in the first sensing interval T1. In other words, the brightness of the pixel rows L2, L3 and L4 changes in sequence from the brightness of the blanking period BP to the brightness of the non-blanking period, as shown in FIG. 8. Assuming that the hue of the pixel rows L2, L3 and L4 is Hs and the second brightness of the pixel rows L2, L3 and L4 is Ls, a first sensing value CountA generated by the ambient light sensor 22 sensing light in the first sensing interval T1 may be expressed by equation EQ-3:

$$\text{CountA}=\text{AL}+3(1-(\text{TP41}-\text{Tg})/\text{T1})\text{Hs}\times\text{Ls} \qquad \text{EQ-3}$$

wherein TP41 is the time length of the blanking period BP of the pixel row L4. After the step S20 ends, the process proceeds to the step S22. In a second sensing interval T2, the ambient light sensor 22 performs a second sensing, wherein the length of the second sensing interval T2 is the same as the length of the first sensing interval T1. The ambient light sensor 22 sensing light in the second sensing interval T2 and generates a second sensing value CountB, which may be expressed by equation EQ-4:

$$\text{CountB}=\text{AL}+3\times\text{Hs}\times\text{Ls} \qquad \text{EQ-4}$$

In the step S24, an ambient light brightness is generated according to the first sensing value CountA and the second sensing value CountB. The first sensing value CountA and the second sensing value CountB are generated by the ambient light sensor 22. The first sensing interval T1, the time length TP41 of the blanking period BP and the first time gap Tg are parameters preset in the electronic device 10. By solving simultaneous equations formed by Equations EQ-3 and EQ-4, Hs×Ls can be eliminated so as to calculate the ambient light intensity AL.

Figure 10:
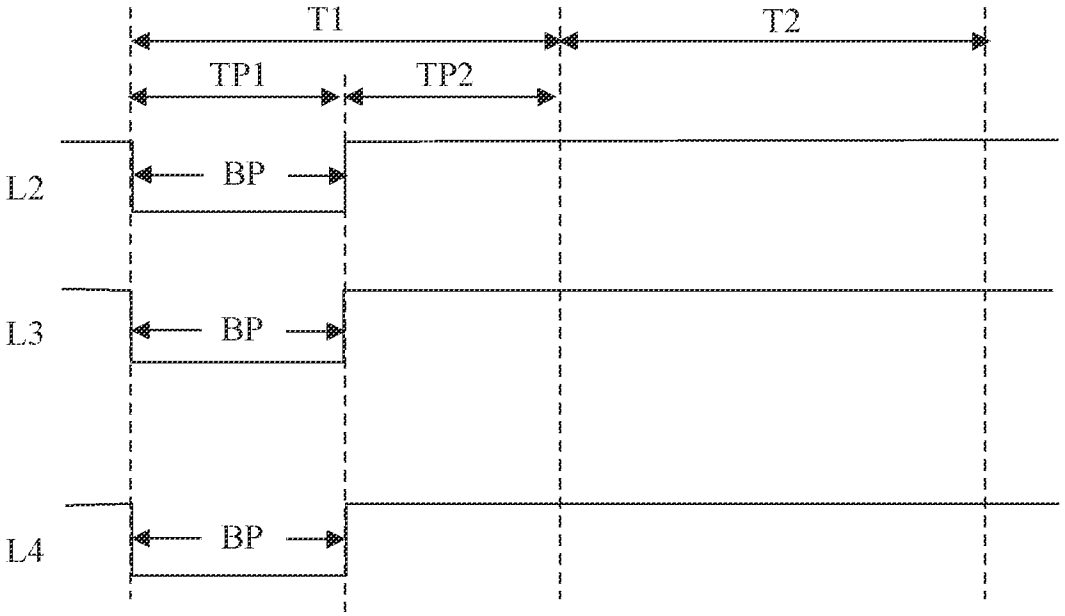
FIG. 10 shows another timing diagram of the pixel rows L2, L3 and L4 in FIG. 7.

FIG. 10 shows another embodiment of the present invention. Different from the embodiment of FIG. 8, the beginning points of the pixel rows L2, L3 and L4 are at the same time point in FIG. 10. However, the pixel rows L2, L3 and L4 respectively have different brightness and different hue in the non-blanking period in this embodiment. For example, the hue of the pixel row L2 is Hs1, the first brightness of the pixel row L2 in the blanking period BP is zero, and a second brightness of the pixel row L2 in the non-blanking period is Ls1. The hue of the pixel row L3 is Hs2, the first brightness of the pixel row L3 in the blanking period BP is zero, and the second brightness of the pixel row L3 in the non-blanking period is Ls2. The hue of the pixel row L4 is Hs3, the first brightness of the pixel row L4 in the blanking period BP is zero, and the second brightness of the pixel row L4 in the non-blanking period is Ls3. In the first sensing interval T1, the brightness of each pixel row changes from the first brightness of the blanking period BP to the second brightness of the non-blanking period. In the second sensing interval T2, each pixel row remains the second brightness.

Figure 11:
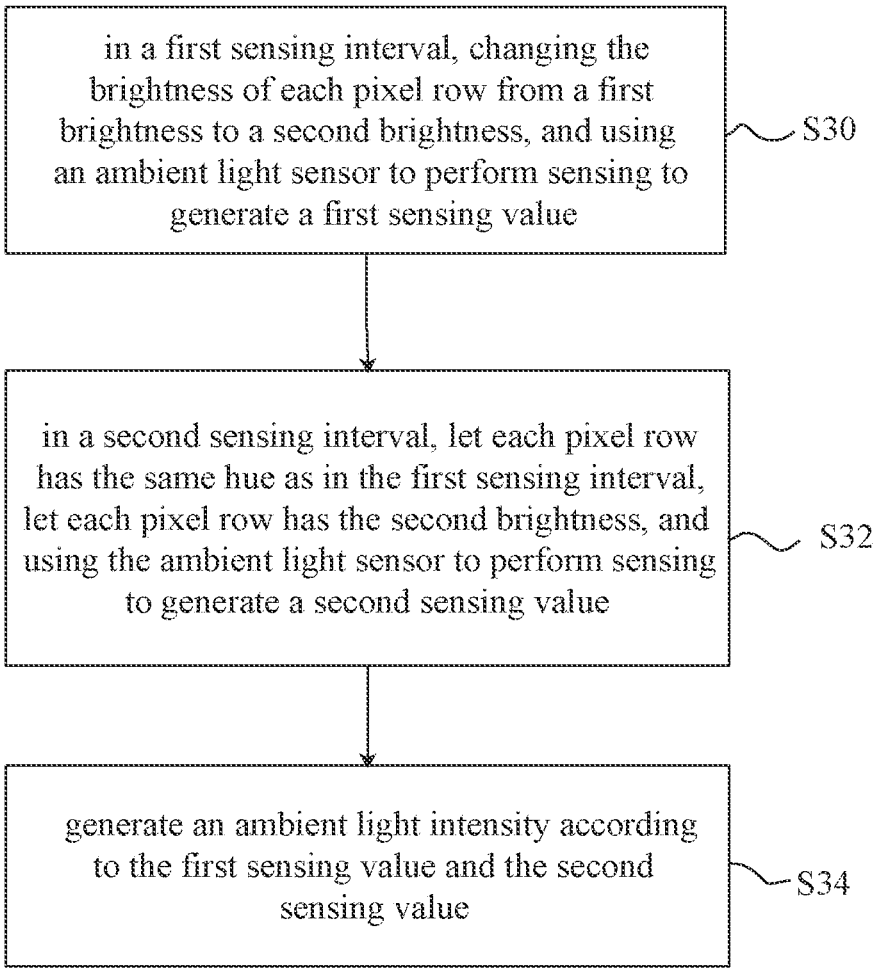
FIG. 11 shows a third embodiment of an ambient light sensing method of the present invention.

FIG. 11 shows a third embodiment of an ambient light sensing method of the present invention. Refer to FIG. 10 and FIG. 11. In the step S30, the ambient light sensor 22 performs a first sensing in the first sensing interval T1. In the first sensing interval T1, the first period TP1 of the first sensing interval T1 is the blanking period BP of the pixel rows L2, L3 and L4. Therefore, the first brightness of each of the pixel rows L2, L3 and L4 in the first period TP1 is zero. After the first period TP1 ends and the second period TP2 starts, the pixel rows L2, L3 and L4 are turned on to respectively have second brightness of Ls1, Ls2 and Ls3 which are non-zero. In FIG. 10, the first period TP1 is the blanking periods BP of the pixel rows L2, L3 and L4, and the second period TP2 is the non-blanking period in the first sensing interval T1. The ambient light sensor 22 sensing light in the first sensing interval T1 to generate a first sensing value CountA, which may be expressed by equation EQ-5 as follows:

$$CountA=AL+(1-TP1/T1)(Hs1\times Ls1+Hs2\times Ls2+Hs3\times Ls3) \quad \text{EQ-5}$$

The step S32 is performed after the step S30. In the step S32, the ambient light sensor 22 performs a second sensing in the second sensing interval T2, wherein the length of the second sensing interval T2 is the same as the length of the first sensing interval T1. In the second sensing interval T2, each of the pixel rows L2, L3 and L4 remains the second brightness Ls1, Ls2 or Ls3 of the second period TP2 and has the same hue Hs1, Hs2 or Hs3 of the first sensing interval T1. The ambient light sensor 22 senses light in the second sensing interval T2 and generates a second sensing value CountB, which may be expressed by equation EQ-6 as follows:

$$CountB=AL+(Hs1\times Ls1+Hs2\times Ls2+Hs3\times Ls3) \quad \text{EQ-6}$$

In the step S34, an ambient light brightness is generated according to the first sensing value CountA and the second sensing value CountB. The first sensing value CountA and the second sensing value CountB are generated by the ambient light sensor 22, and TP1 and T1 are parameters preset in the electronic device 20. Therefore, by solving the simultaneous equations formed by the equations EQ-5 and EQ-6, the term (Hs1×Ls1+Hs2×Ls2+Hs3×Ls3) can be eliminated so as to calculate the ambient light intensity AL.

In the embodiment of FIG. 10, the beginning point of the first sensing interval T1 is the beginning point of the blanking period BP of the pixel rows L2, L3 and L4. However, the present invention is not limited by this embodiment. In one embodiment, the beginning point of the first sensing interval T1 can be after the beginning point of the blanking period BP by a time delay Td and before the ending point of the blanking period BP. Therefore, the first period TP1 is a portion of the blanking period BP. Since the time delay Td may be predetermined and TP1=BP−Td is a known parameter, the ambient light intensity AL can be acquired according to the method shown in FIG. 11.

The embodiments have been described above to demonstrate the present invention to enable the persons skilled in the art to understand, and make use of the present invention. However, these embodiments are only to exemplify the present invention but not to limit the scope of the present invention. Any modification or variation according to the spirit, principle, and/or characteristic of the present invention is to be also included by the scope of the present invention, which is based on the claims stated below and the equivalents thereof.

What is claimed is:

1. An ambient light sensing method of an electronic device, said electronic device comprising an organic light-emitting diode (OLED) display and an ambient light sensor, said OLED display comprising a plurality of pixels, said ambient light sensor disposed under a first pixel of said plurality of pixels, said ambient light sensing method comprising following steps:

sensing light by said ambient light sensor in a first sensing interval to generate a first sensing value, wherein said first sensing interval comprises a first period and a second period, and said first pixel has a first brightness in said first period and has a second brightness in said second period;

sensing light by said ambient light sensor in a second sensing interval to generate a second sensing value, wherein said second sensing interval and said first sensing interval have an identical time length, and said first pixel has said second brightness in said second sensing interval; and acquiring an ambient light intensity according to said first sensing value and said second sensing value;

wherein said first pixel has an identical hue in said first sensing interval and said second sensing interval.

2. The ambient light sensing method according to claim 1, wherein said first period is whole or a portion of a blanking period, and said blanking period is used to update display information of said first pixel.

3. The ambient light sensing method according to claim 2, wherein said first period is said blanking period, and a beginning point of said first sensing interval is a beginning point of said blanking period.

4. The ambient light sensing method according to claim 1, further comprising following steps:

counting time of a frame of said OLED display according to a first operating frequency generated by an oscillator, to generate a count value;

determining a preset value according to a frame rate of said OLED display; and calibrating said oscillator according to said count value and said preset value to generate a second operating frequency.

5. An ambient light sensing method of an electronic device, said electronic device comprising an organic light-emitting diode (OLED) display and an ambient light sensor, said OLED display comprising a plurality of pixel rows adjacent to each other, said ambient light sensor disposed under said plurality of pixel rows, said ambient light sensing method comprising following steps:

sensing light by said ambient light sensor in a first sensing interval to generate a first sensing value, and making brightness of said plurality of pixel rows changes in sequence from a first brightness to a second brightness in said first sensing interval;

sensing light by said ambient light sensor in a second sensing interval to generate a second sensing value, wherein said second sensing interval and said first sensing interval have an identical time length, and said plurality of pixel rows has said second brightness in said second sensing interval; and acquiring an ambient light intensity according to said first sensing value and said second sensing value;

wherein said plurality of pixel rows have an identical hue in said first sensing interval and said second sensing interval.

6. The ambient light sensing method according to claim 5, wherein each said pixel row updates display information in a blanking period, said blanking period is shorter than said first sensing interval, there is a first time gap between beginning points of said blanking period of two adjacent pixel rows of said plurality of pixel rows, and each said pixel row has a first brightness in said blanking period and a second brightness in a non-blanking period.

7. The ambient light sensing method according to claim 6, wherein a beginning point of said first sensing interval is a beginning point of said blanking period of a last one of said plurality of pixel rows.

8. The ambient light sensing method according to claim 5, further comprising following steps:

counting time of a frame of said OLED display according to a first operating frequency generated by an oscillator, to generate a count value;

determining a preset value according to a frame rate of said OLED display; and calibrating said oscillator according to said count value and said preset value to generate a second operating frequency.

9. An ambient light sensing method of an electronic device, said electronic device comprising an organic light-emitting diode (OLED) display and an ambient light sensor, said OLED display comprising a plurality of pixel rows adjacent to each other, said ambient light sensor disposed under said plurality of pixel rows, said ambient light sensing method comprising following steps:

sensing light by said ambient light sensor in a first sensing interval to generate a first sensing value, wherein said first sensing interval comprises a first period and a second period, and each said pixel row has a first brightness in said first period and has a second brightness in said second period;

sensing light by said ambient light sensor in a second sensing interval to generate a second sensing value, wherein said second sensing interval and said first sensing interval have an identical time length, and each said pixel row has said second brightness in said second sensing interval; and acquiring an ambient light intensity according to said first sensing value and said second sensing value;

wherein each said pixel row has an identical hue in said first sensing interval and said second sensing interval.

10. The ambient light sensing method according to claim 9, wherein said first period is whole or a portion of a blanking period, and said blanking period is used to update display information of each said pixel row.

11. The ambient light sensing method according to claim 10, wherein a beginning point of said first sensing interval is a beginning point of said blanking period.

12. The ambient light sensing method according to claim 9, further comprising following steps:

counting time of a frame of said OLED display according to a first operating frequency generated by an oscillator, to generate a count value;

determining a preset value according to a frame rate of said OLED display; and calibrating said oscillator according to said count value and said preset value to generate a second operating frequency.

13. An electronic device, comprising:

an organic light-emitting diode (OLED) display, including a plurality of pixels; and an ambient light sensor, disposed under a first pixel of said plurality of pixels, configured to generate a first sensing value in a first sensing interval, generate a second sensing value in a second sensing interval, and acquire an ambient light intensity according to said first sensing value and said second sensing value;

wherein said first sensing interval comprises a first period and a second period, and said first pixel has a first brightness in said first period and has a second brightness in said second period;

wherein said second sensing interval and said first sensing interval have an identical time length, and said first pixel has said second brightness in said second sensing interval;

wherein said first pixel has an identical hue in said first sensing interval and said second sensing interval.

14. The electronic device according to claim 13, wherein said first period is whole or a portion of a blanking period, and said blanking period is used to update display information of said first pixel.

15. The electronic device according to claim 14, wherein said first period is said blanking period, and a beginning point of said first sensing interval is a beginning point of said blanking period.

16. The electronic device according to claim 13, wherein said ambient light sensor comprising:

an oscillator, configured to generate a first operating frequency;

a counter, coupled to said oscillator, and configured to count time of a frame of said OLED display according to a first operating frequency generated by an oscillator, to generate a count value; and a comparison circuit, coupled to said oscillator and said counter, and configured to calibrate said oscillator according to a preset value and said count value to generate a second operating frequency;

wherein said preset value is determined according to a frame rate of said OLED display.

17. An electronic device, comprising:

an organic light-emitting diode (OLED) display, including a plurality of pixel rows adjacent to each other; and an ambient light sensor, disposed under said plurality of pixel rows, configured to generate a first sensing value in a first sensing interval, generate a second sensing value in a second sensing interval, and acquire an ambient light intensity according to said first sensing value and said second sensing value;

wherein brightness of said plurality of pixel rows changes from a first brightness to a second brightness in said first sensing interval;

wherein said second sensing interval and said first sensing interval have an identical time length, and said plurality of pixel rows has said second brightness in said second sensing period;

wherein said plurality of pixel rows has an identical hue in said first sensing interval and said second sensing interval.

18. The electronic device according to claim 17, wherein each said pixel row updates display information in a blanking period, said blanking period is shorter than said first sensing interval, there is a first time gap between beginning points of said blanking periods of two adjacent pixel rows of said plurality of pixel rows, and each said pixel row has a first brightness in said blanking period and a second brightness in a non-blanking period.

19. The electronic device according to claim 17, wherein said ambient light sensor comprises:

an oscillator, configured to generate a first operating frequency;

a counter, coupled to said oscillator, and configured to count time of a frame of said OLED display according to a first operating frequency generated by an oscillator, to generate a count value; and a comparison circuit, coupled to said oscillator and said counter, calibrating said oscillator according to a preset value and said count value to generate a second operating frequency;

wherein said preset value is determined according to a frame rate of said OLED display.

20. An electronic device, comprising:

an organic light-emitting diode (OLED) display, including a plurality of pixel rows adjacent to each other; and an ambient light sensor, disposed under said plurality of pixel rows, configured to generate a first sensing value in a first sensing interval, generate a second sensing value in a second sensing interval, and acquire an ambient light intensity according to said first sensing value and said second sensing value;

wherein said first sensing interval comprises a first period and a second period, and each said pixel row has a first brightness in said first period and has a second brightness in said second period;

wherein said second sensing interval and said first sensing interval have an identical time length, and each said pixel row has said second brightness in said second sensing period;

wherein each said pixel row has an identical hue in said first sensing interval and said second sensing interval.

21. The electronic device according to claim 20, wherein said first period is whole or a portion of a blanking period, and said blanking period is used to update display information of each said pixel row.

22. The electronic device according to claim 21, wherein a beginning point of said first sensing interval is a beginning point of said blanking period.

23. The electronic device according to claim 21, wherein said ambient light sensor comprises:

an oscillator, configured to generate a first operating frequency;

a counter, coupled to said oscillator, and configured to count time of a frame of said OLED display according to a first operating frequency generated by an oscillator, to generate a count value; and a comparison circuit, coupled to said oscillator and said counter, calibrating said oscillator according to a preset value and said count value to generate a second operating frequency;

wherein said preset value is determined according to a frame rate of said OLED display.

* * * * *